US007941927B1

(12) United States Patent
Demko

(10) Patent No.: US 7,941,927 B1
(45) Date of Patent: May 17, 2011

(54) FOLDING KNIFE LOCK

(75) Inventor: Andrew Demko, Wampum, PA (US)

(73) Assignee: Cold Steel, Ventura, CA (US)

( * ) Notice: Subject to any disclaimer, the term of this patent is extended or adjusted under 35 U.S.C. 154(b) by 332 days.

(21) Appl. No.: 12/001,045

(22) Filed: Dec. 10, 2007

(51) Int. Cl.
*B26B 1/04* (2006.01)
*B26B 1/00* (2006.01)

(52) U.S. Cl. ..... 30/161; 30/157

(58) Field of Classification Search ..... 30/155–163
See application file for complete search history.

(56) References Cited

U.S. PATENT DOCUMENTS

| | | | | |
|---|---|---|---|---|
| 1,614,949 | A * | 1/1927 | Finley | 30/308.2 |
| 3,868,774 | A | 3/1975 | Miori | |
| 4,451,982 | A * | 6/1984 | Collins | 30/161 |
| 4,730,394 | A | 3/1988 | Sonner, Jr. | |
| 4,837,932 | A * | 6/1989 | Elsener | 30/161 |
| 4,901,439 | A | 2/1990 | Boyd, Jr. | |
| 5,044,079 | A | 9/1991 | Gibbs | |
| 5,095,624 | A * | 3/1992 | Ennis | 30/161 |
| 5,425,175 | A * | 6/1995 | Rogers | 30/161 |
| 5,615,484 | A * | 4/1997 | Pittman | 30/161 |
| 6,079,106 | A * | 6/2000 | Vallotton | 30/161 |
| 6,154,965 | A * | 12/2000 | Sakai | 30/161 |
| 6,378,214 | B1 | 4/2002 | Onion | |
| 6,591,504 | B2 | 7/2003 | Onion | |
| 6,684,510 | B1 | 2/2004 | Collins | |
| 7,032,315 | B1 * | 4/2006 | Busse | 30/153 |
| 7,506,446 | B2 * | 3/2009 | Onion | 30/160 |
| 2007/0068001 | A1 * | 3/2007 | Steigerwalt | 30/161 |

* cited by examiner

*Primary Examiner* — Laura M. Lee
(74) *Attorney, Agent, or Firm* — Harpman & Harpman

(57) ABSTRACT

A folding knife having a movable locking element that locks the blade in open position and retains the blade in secure closed position within an integrated spaced parallel monolithic handle frame member. A spring-urged locking retainment arm engages corresponding parallel portions of the blade shank when in respective locked open and locked closed positions. Sliding longitudinal displacement of the retainment arm allows for progressive engaged rotation of the blade shank about a pivot mounting point to a fully closed and locked position against two blade shank engagement points by the locking arm.

4 Claims, 4 Drawing Sheets

FOLDING KNIFE LOCK

BACKGROUND OF THE INVENTION

1. Technical Field

This invention relates to folding knives that have a blade pivoting from a locked open position to a closed retained position within the handles.

2. Description of Prior Art

Prior art folding knives of this type are known having folding blades which lock in open use position. Such well known knives have a lock spring which engages a portion of the blade to prevent it from unassisted opening when in closed position and to maintain it in locked open use position. Such knife construction imparts a frictional resistance to the pivoting shank of the blade allowing for user control as the blade is opened or closed. This design also prevents the extended open blade from unintentional closing which could induce injury to the user. Other prior art folding knives with improved locking mechanisms can be seen in U.S. Pat. Nos. 3,868,774, 4,730,394, 4,901,439, 5,044,079, 6,378,214, 6,591,504 and 6,684,510.

In U.S. Pat. No. 4,730,394 a folding camp knife can be seen having an elongated handle with a knife blade pivotally positioned therein. The blade shank has a plurality of annularly spaced rail notches therein for registration with a locking folding flange slidably mounted to the side of the handle.

U.S. Pat. No. 3,868,774 disclosed a folding blade knife with a lock in which a sliding lock bar is selectively engaged on a portion of the blade tang for lock open and lock closed position.

U.S. Pat. No. 4,730,394 is directed to a folding knife having a locking blade with a single lock position. The blade is locked only in open position, not in closed folded position within the sheath.

U.S. Pat. No. 5,044,079 claims a folding knife with opened lock improved spring element. A locking bar is pivoted so as to selectively engage and release with a notch in the blade pivot tang.

A moving locking mechanism of a blade in a folding knife can be seen in U.S. Pat. No. 6,378,214 in which a locking part is slidably held by the blade to slide along a portion thereof for selective engagement.

U.S. Pat. No. 6,591,504 shows a locking folding knife with safety features having a lock that slides to prevent the blade from opening by blocking the blade path on its free end.

U.S. Pat. No. 6,684,510 discloses a self-locking folding knife which automatically locks when moved to open use position. The blade has a pivot tang with a pair of opposing lock engagement surfaces on which a spring urged pin is selectively engaged when in open and closed position respectively.

SUMMARY OF THE INVENTION

A folding knife of the invention which automatically locks in open use position and correspondingly in folded closed position. A sliding locking bar is user retracted against a resilient element with an angular forward end and tab blade engagement surfaces allowing the blade to be pivoted out of the open locked or closed lock registration with the locking bar surface. Retaining spring pressure holds the locking bar against the blade until deliberately retracted by the user for opening and closing sequence.

DETAILED DESCRIPTION OF THE INVENTION

Figure 1:
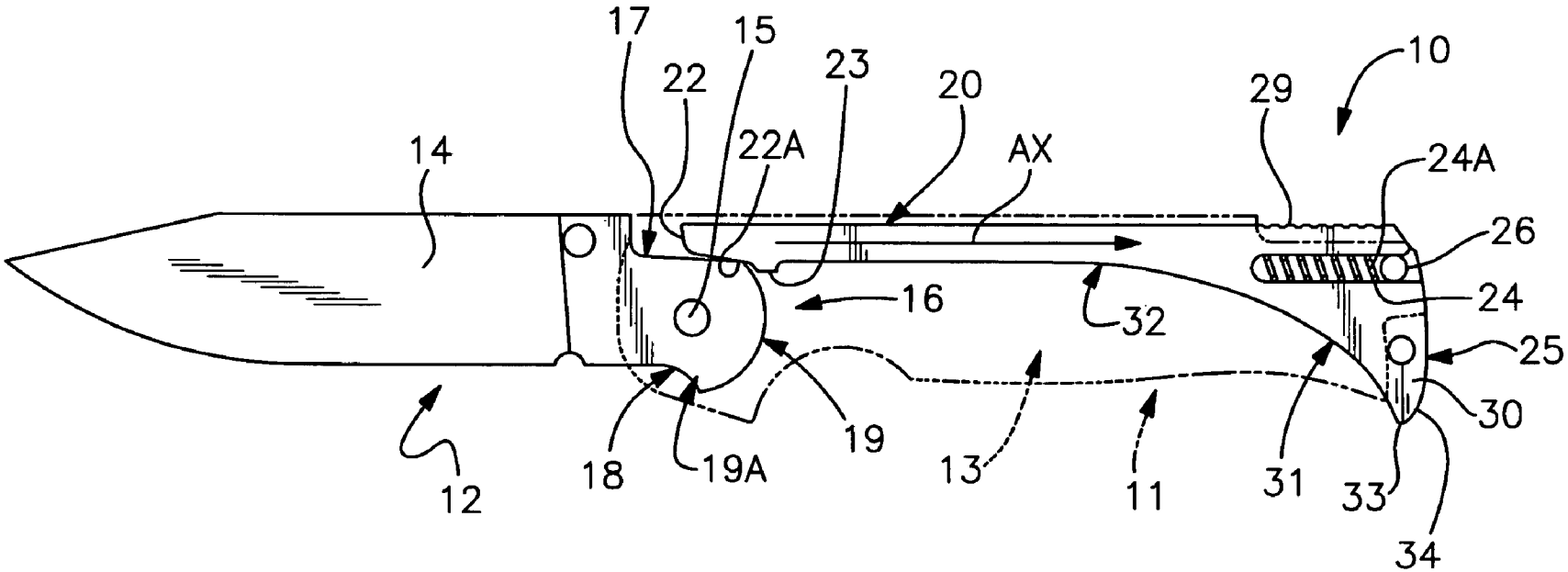
FIG. 1 is a side elevational view with portions broken away of the knife of the invention in open locked use position.

Referring to FIG. 1 of the drawings, a folding knife 10 of the invention can be seen in blade open locked position having a handle portion 11 and a blade portion 12. The handle portion 11 has a U-shaped main frame member 13 with a knife blade 14 pivotally connected thereto by a pivot pin 15 extending between the parallel portions of the frame member 13. The blade 14 has a tang end portion 16 about the pivot pin 15 with an upper edged locked open engagement surface 17 and a parallel lower locked closed engagement surface 18 interconnected by an arcuate end edge surface 19. A transition edge portion 19A from the lower surface 18 will become a closed retainment point as described in greater detail hereinafter.

A sliding locking arm fitting 20 extends within a guide channel 21 formed by the main frame member 13 having a forward end blade tang engagement surface 22, and a lower surface 22A with a depending tab blade retainment portion 23 inwardly thereof.

The locking arm fitting 20 has a spring receiving slot 24 for a coil spring 24A extending inwardly from its oppositely disposed end 25 with a transverse spring pin 26 secured to the main frame member 13 interengaging same.

Figure 4:
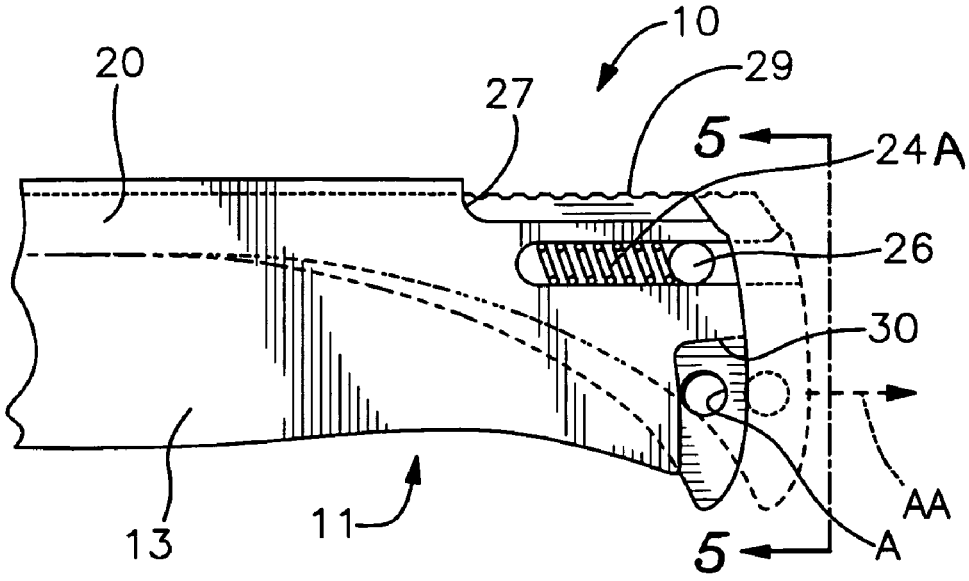
FIG. 4 is an enlarged partial side elevational view in broken and solid lines indicating lock activation movement.

The integral frame member 13 has upper end cut-a-way portions 27 and 28 as shown in broken lines in FIG. 1 of the drawings and solid lines in FIG. 4 of the drawings which allows user access to the arm fitting 20 which has a ribbed upper edge surface 29 positioned therewithin and a contoured apertured lower portion 30 respectively. The locking arm fitting 20 has a lower curved edge surface 31 extending from a transition point 32 to a terminal bottom end intersection 33 with an arcuate end edge 34 of its contoured apertured lower portion 30 of the oppositely disposed end 25 thereof as hereinbefore described.

Figure 2:
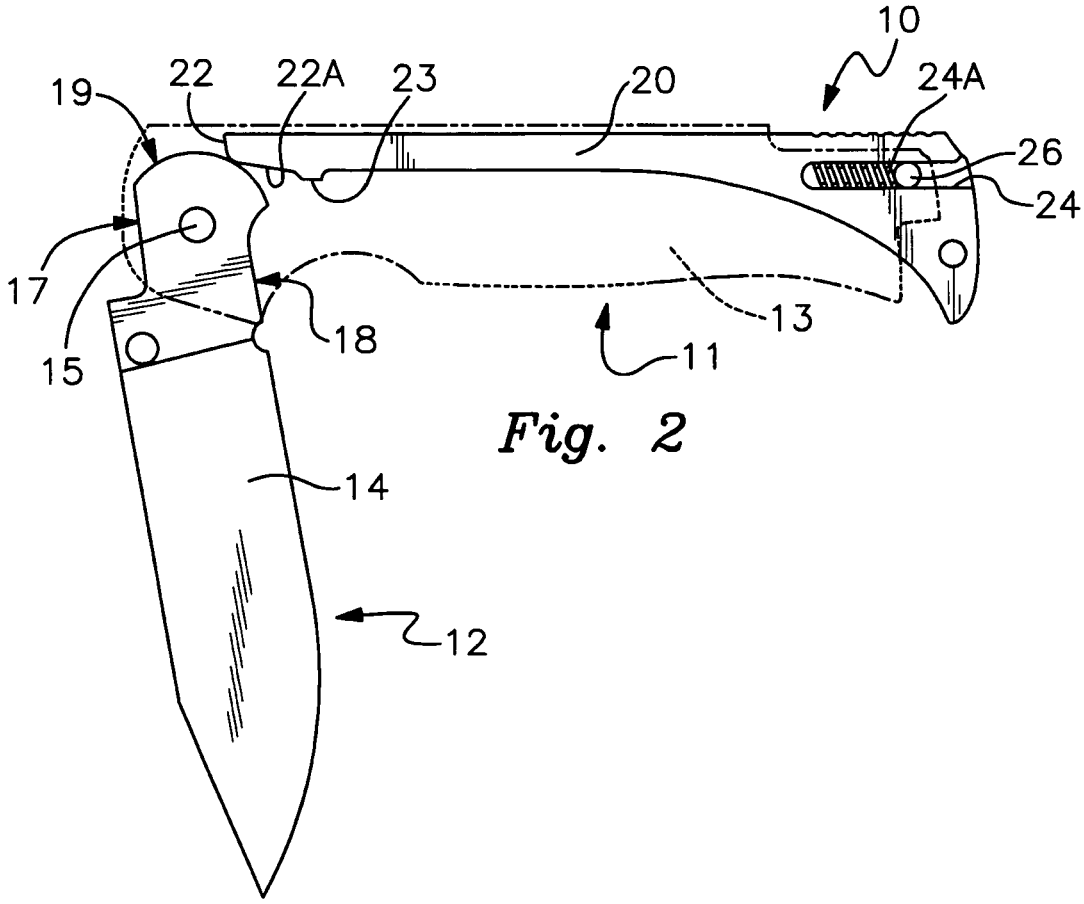
FIG. 2 is a side elevational view thereof in partially closed blade position.
Figure 3:
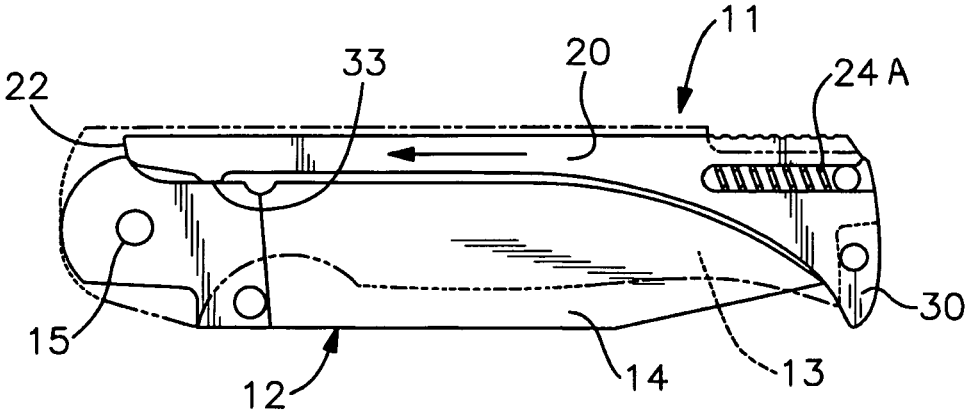
FIG. 3 is a side elevational view thereof in closed blade position.

Referring now to FIGS. 1, 2 and 3 of the drawings, the knife blade 14 is illustrated in a closing sequence wherein the open locked blade 14 position seen in FIG. 1 of the drawings is characterized by the overlapping engagement of the locking arm 20 end engagement surface 22 against the corresponding engagement surface 17 of the tang 16 when fully forward under the force of the spring 24A.

To close the blade 14 a user (not shown) must manually and deliberately engage the locking arm 20 via its ribbed arm surface 29 exposed by the cut-a-way main frame member 13 or by selective engagement via an aperture A in the end portion 30 thereof. The locking arm 20 is then manually pulled back along its longitudinal axis indicated by axial arrow AX allowing the blade 14 to manually pivot on the pivot pin 15 as seen in FIG. 2 of the drawings. It will be evident that as the blade 14 pivots, the arcuate edge 19 of the tang portion 16 will engage and maintain the locking arm 20 retracted position as rotation occurs thereon. As the blade 14 pivots around its arcuate surface 19, the locking arm 20 will move forward under the spring 24 resilient force, the arms forward engagement surface 22 will registerably engage the surface of the transition edge portion 19A as seen in FIG. 3 of the drawings. The arm tab 23 will correspondingly engage the upper edge locked closed surface 18 of the tang portion 16 assuring a safe and secure retention of the blade 14 within the handle portion 11 when closed as best seen in FIG. 3 of the drawings.

It will be evident that to open the knife 10 the locking arm 20, as noted, must be retracted again as seen in FIG. 4 of the drawings in broken lines indicated by activation arrows AA against the spring 24A allowing the blade 14 to be pivoted from a closed position to open position as illustrated again by FIG. 2 of the drawings in which the arm fitting 20 has been retracted along its longitudinal axis as hereinbefore described.

Figure 5:
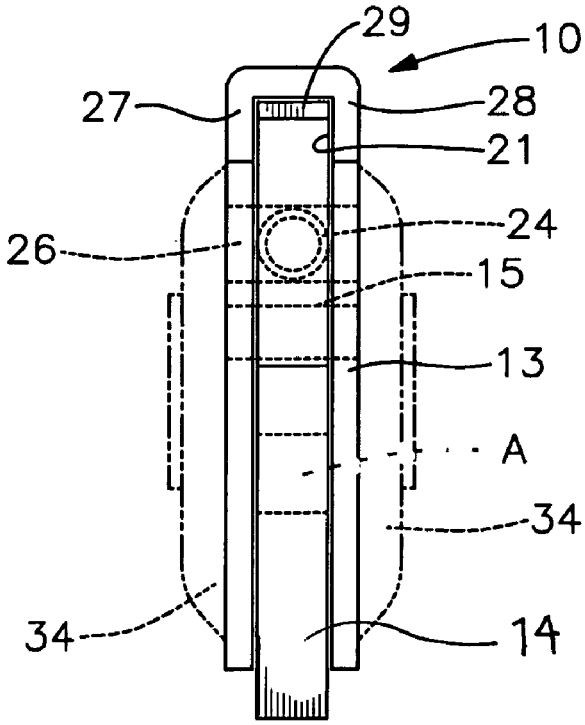
FIG. 5 is an end view on lines 5-5 of FIG. 4.
Figure 6:
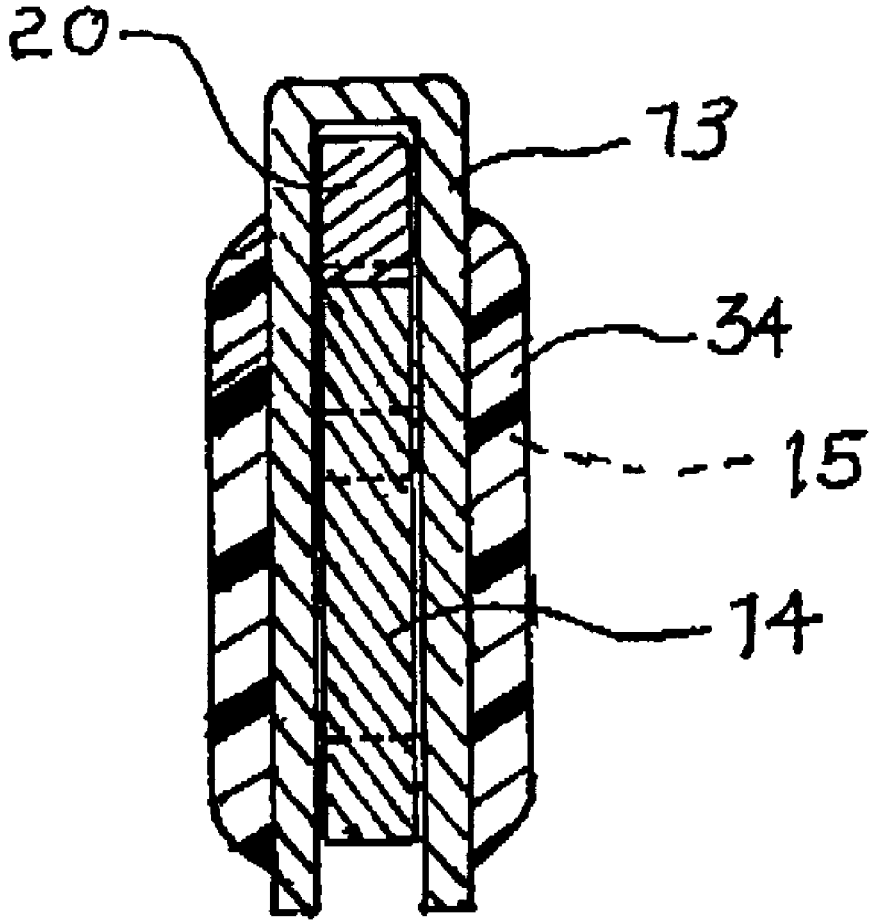
FIG. 6 is a sectional view on lines 6-6 of FIG. 1.

Referring now to FIG. 5 of the drawings, the U-shaped main frame 13 can be seen that provides for an integrated frame construction wherein the critical blade pivot pin 15 is supported by the monolithic one-piece frame member respective spaced parallel portions simplifying construction and adding additional transverse support onto which hand grips 34 are secured (shown in broken lines) as will be well known by those skilled in the art.

Additionally, the spaced parallel surfaces of the main frame 13 provide selective mounting surfaces, as noted, as well as opposing apertured mounting areas for the spring retention pin 26 as previously described.

It will thus be seen that a new and novel locking and retainment mechanism for a folding knife has been illustrated and described which provides a safe and secure simplified locking mechanism for a folding knife blade in both open locked, intermediate transition period position and secure locking retainment position within the handle defined by the unique one-piece U-shaped main frame portion 13 allowing for integrated blade and locking arm component elements therewithin and it will be apparent to those skilled in the art that various changes and modifications may be made thereto without departing from the spirit of the invention.

Therefore I claim:

1. A folding knife comprising, an elongated handle portion, a blade pivotally secured to said handle for movement from a retracted locked position within the handle to an extended locked use position, a locking arm slidably disposed with said handle for selective engagement on oppositely disposed parallel edge engagement portions of said blade, said locking arm and said parallel edge engagement portions of said blade are of an equal cross-sectional dimension, a transition blade edge portion between said blade parallel edge engagement portions engaged by a free end of said locking arm, a selective blade edge engagement lug extending from said locking arm in spaced longitudinal relation to said free end of said locking arm engaging said blade edge only when in blade closed lock position, a spring receiving slot in said locking arm extending inwardly in oppositely disposed relation to said blade engagement free end of said locking arm, and means for rectilinear movement of said locking arm against a spring, said spring retained within said spring receiving slot by a pin, said locking arm extends longitudinally outwardly from said handle to release said blade for movement.

2. The folding knife set forth in claim 1 wherein said handle is defined by an elongated monolithic U-shaped support frame member, and a channel formed within said support frame member for slidably disposing said locking arm therewithin.

3. The folding knife set forth in claim 1 wherein means for rectilinear movement of said locking arm against said spring comprises, an exposed ribbed upper end edge surface of said locking arm in parallel vertically spaced aligned relation to said spring.

4. The folding knife set forth in claim 1 wherein said spring is a coil spring.

* * * * *